United States Patent [19]

Kuzara, Jr.

[11] Patent Number: 4,829,727

[45] Date of Patent: May 16, 1989

[54] METHOD AND APPARATUS FOR PREPARING A FRAME FOR INSTALLATION IN A DOOR OPENING

[75] Inventor: George P. Kuzara, Jr., Mesa, Ariz.

[73] Assignee: Pressteel, Inc., Chandler, Ariz.

[21] Appl. No.: 948,240

[22] Filed: Dec. 31, 1986

[51] Int. Cl.[4] ..... E04G 23/00

[52] U.S. Cl. ..... 52/127.2; 52/217; 248/544; 248/351

[58] Field of Search ..... 52/749, 127.2, 217, 52/233 R; 248/544, 351

[56] References Cited

U.S. PATENT DOCUMENTS

| | | | |
|---|---|---|---|
| 1,754,762 | 4/1930 | Nelson . | |
| 2,595,506 | 5/1952 | Backman . | |
| 2,600,072 | 6/1952 | Peremi . | |
| 2,835,933 | 5/1958 | Evans . | |
| 2,914,813 | 12/1959 | Christian et al. | 52/127.2 |
| 3,027,686 | 4/1962 | Oates . | |
| 3,065,550 | 11/1962 | Pattiani | 52/749 |
| 3,224,152 | 12/1965 | Evans | 52/217 |
| 3,403,486 | 10/1968 | Schubeis | 52/127 |
| 3,469,360 | 9/1969 | Peterson et al. | 52/217 |
| 3,995,843 | 12/1976 | Kasteler | 269/47 |
| 4,048,771 | 9/1977 | Thistlethwaite | 52/127 |
| 4,067,157 | 1/1978 | Robinson | 52/127 |
| 4,141,192 | 2/1979 | Augustine | 52/217 |
| 4,453,346 | 6/1984 | Powell et al. | 49/404 |

FOREIGN PATENT DOCUMENTS

| | | | |
|---|---|---|---|
| 903374 | 2/1954 | Fed. Rep. of Germany | 52/127.2 |
| 2841480 | 4/1980 | Fed. Rep. of Germany | 52/217 |
| 1227626 | 3/1960 | France | 52/127.2 |
| 2294308 | 7/1976 | France | 52/127.2 |

*Primary Examiner*—David A. Scherbel
*Assistant Examiner*—Caroline D. Dennison
*Attorney, Agent, or Firm*—Charles E. Cates

[57] ABSTRACT

Apparatus and method for squaring and decambering at the assembly plant, and shimming at the job site, a thin metal door frame wherein the frame becomes an integral part of its own setting jig until installation, after which the semi-permanent setting jig is removed. Temporary jigs are used in the method to set the minimum door width tolerance and to square the frame elements.

3 Claims, 2 Drawing Sheets

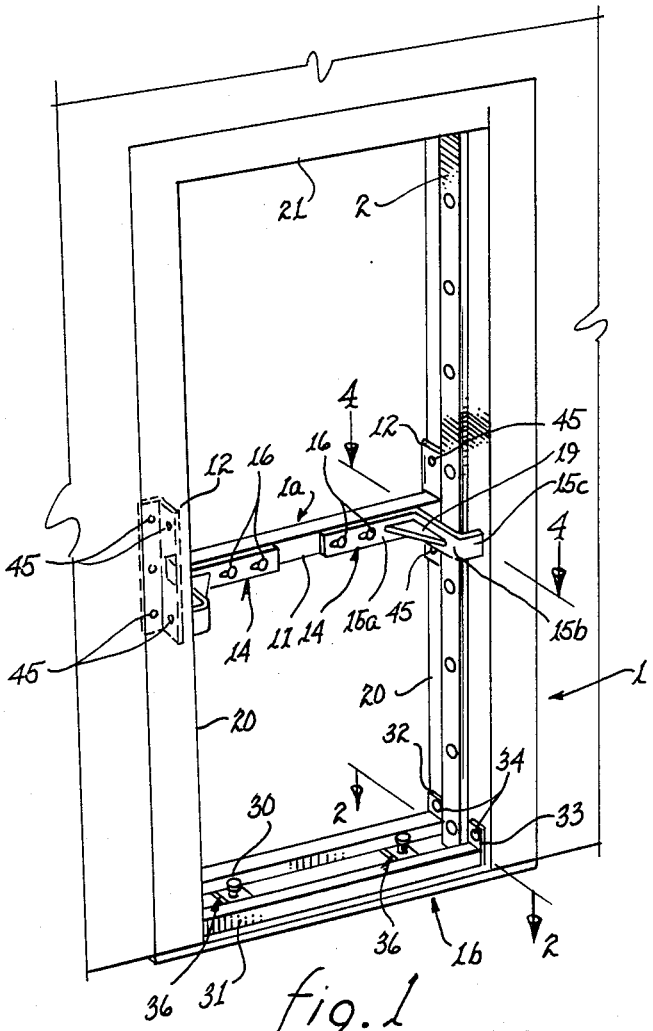
fig. 1
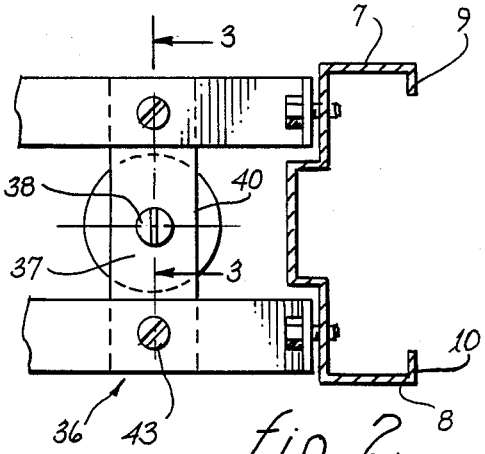
fig. 2
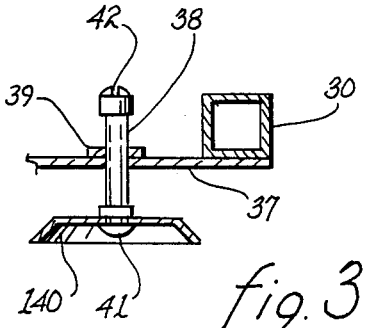
fig. 3
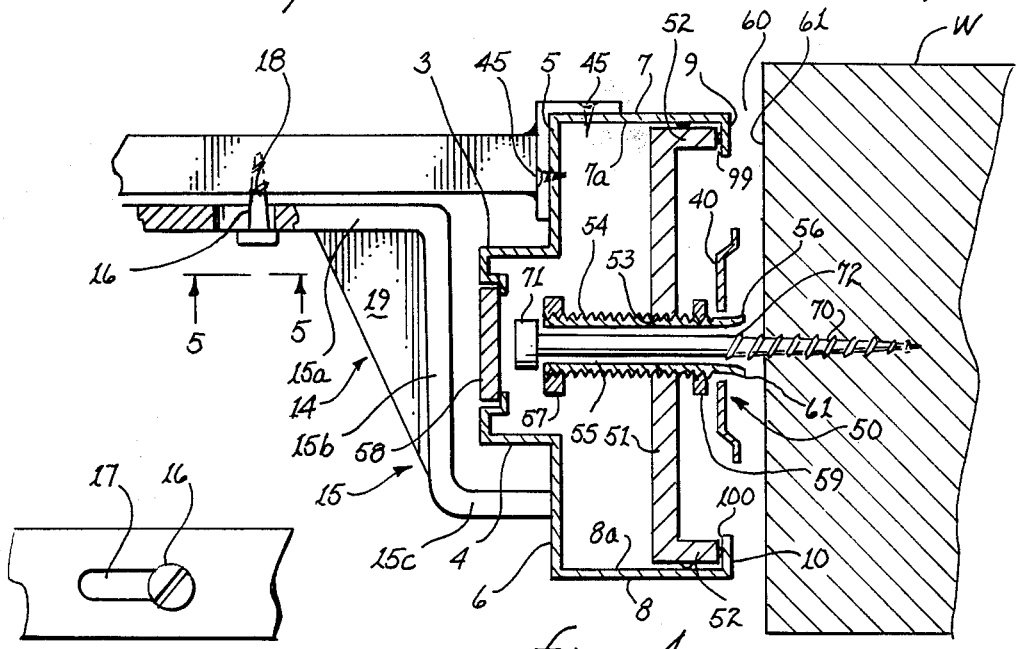
fig. 4
fig. 5

METHOD AND APPARATUS FOR PREPARING A FRAME FOR INSTALLATION IN A DOOR OPENING

BACKGROUND OF THE INVENTION

This invention relates to improvements in one-piece metal door frames of the type having a pair of opposed jambs and a connecting header, which frames incorporate a central soffit, a pair of flanking stops, rabbets flanking said stops, and trim faces flanking said rabbets, and improvements in methods of assembling same.

As is known to the trade, the major components of such frames, which are jambs and headers, are customarily shipped to an assembly plant (near the site of proposed use in construction) to be assembled and further transported to the job site. Also, as known to the trade, cooperating metal tabs and slots are provided in the appropriate ends of the jambs and header to facilitate forming the frame corners which are then welded to make the junction stronger. In the prior art method the corners are squared by measurement, a weld is made on the joint, the jambs might or might not be braced, and a load of frames is trucked to the construction job site.

The resulting frame assembly is often out of square when it leaves the assembly plant or becomes so after handling en route to or at the job site.

The problem of dealing with imperfectly aligned frames has been customarily dealt with on the job site as a building construction problem, and the usual strategems and devices used at the job site are directed primarily at preventing further deformation of the frame after it is positioned in a doorway; e.g., from grout, twisted studs and shifting of doorway wall opening elements.

Accordingly, various devices for use at the job site have been made to correct defects, and to prevent further deviation caused by on-site stresses such as pressure from poured concrete, and to compensate for out of square door openings.

Some success at squaring the frame and keeping the frame members in the same plane after installation has been achieved at the job site, but truing of the frame after the frame leaves the assembly plant is difficult and of limited success.

Also, factory jambs ordinarily have a camber (the curve that a long section of formed thin steel assumes when responding to the stresses created by forming with a press break o by roll forming) as a result of the break form or roll form step at the factory, the latter condition either not being known or not understood or treated properly at the local assembly plant.

BRIEF DESCRIPTION OF THE INVENTION

The improvement in the method of assembling thin metal frames includes the step of precisely positioning the two jambs and the header (component parts of the frame) with a spacer bar before the tabs are fixed (as by bending and hammering closed), and removing the camber from the jambs. An integral jig is combined with the frame wherein a first element of a middle spreader and a foot spreader are attached on the door opening (first) side of the frame, the frame is turned over and, in subsequent steps, second elements of a middle spreader and foot spreader are installed on the off (second) side. In the assembly of a thin steel frame according to the invention, the frame becomes an integral part of its own setting jig. The apparatus is further described hereafter.

Squaring/Decambering/Retaining Apparatus

In combination with a one-piece, thin-metal door frame having an inverted U-shape with two vertical jambs, wherein the header is at the top and the open end of the U is at the foot, and further having means on the face of the frame defining a soffit, two stops flanking the soffit, two rabbets flanking the stops and two trim faces flanking the rabbets; apparatus for decambering, and shimming, the frame is provided. The apparatus has a middle spreader means having a beam extending between the jambs at a location intermediate the header and the foot; elongate first braces extending from each end of the beam perpendicular to the beam length, the first braces having means for releasably engaging a first rabbet and an associated trim face of each jamb on the door opening side of the frame; an auxiliary brace detachably affixed to the beam and bearing on the second rabbet on the off side of the frame on each of the jambs; and a pair of cooperating foot spreader bars releasably attached to the jambs at the open end, the bars being spaced from the middle spreader bar.

Additionally, the apparatus described may incorporate means for leveling the foot spreader bars (and consequently the entire frame) comprising at least two cross members spanning the foot spreader bars, a threaded bolt rotatably carried by each of the cross braces and having two ends, one of which is adapted to engage the floor beneath the foot and the other of which is provided with means for engaging a turning tool. The apparatus may further comprise a support beam, one end of which engages the middle spreader and the other end of which releasably engages the header.

The Shimming/Fastening Apparatus

Also, a one-piece metal door frame as described is combined with apparatus for shimming and anchoring said frame comprising a girder rigidly affixed to two of the inside surfaces of the frame; means defining a tapped bore in the girder; an axially hollow tube having external thread means rotatably engaged in the tapped bore in the girder and means for axially engaging a turning tool; a screw extending through the hollow tube for engagement with a wall area around an existing door opening, the screw having a head larger than the inside diameter of the tube; an opening in the soffit of the frame providing axial access to the tube and screw; and means for closing and concealing the opening in the soffit after use.

The Method

It has been discovered that removing camber from the frame at the assembly plant works a great improvement, and that the instant method of performing the squaring and decambering operations at the factory and preserving the relationship until installation is markedly superior to prior art methods.

In a method of assembling, squaring and maintaining the correct, positional attitude of the jambs and header in a metal door frame of the type having a soffit and successively flanking stops, rabbets and trim faces, the improvement is the step comprising removing the camber in the frame at the assembly plant, and in a preferred embodiment the steps of inserting a middle spreader having elongate first and second braces to cause the first braces to bear on the opposed rabbets of the door opening side of the jambs of the frame and the second braces to bear on the opposed rabbets of the jambs on the off side of the frame, whereby the camber is removed.

The steps of squaring the frame and removing camber therefrom are performed, and apparatus adapted to maintain the frame in square and camber-free condition is installed at the assembly plant and retained on the frame while the frame is installed for use in a suitable building door rough opening.

BRIEF DESCRIPTION OF THE DRAWINGS

Turning now to the drawings in which a presently preferred embodiment of the apparatus is depicted:

FIG. 1 is a perspective view of a door frame with integral jig made according to the method of this invention;

FIG. 2, a plan view, in section, taken along the is lines 2—2 in FIG. 1;

FIG. 3 is a elevation view, in section, taken along the lines 3—3 of the device of FIG. 2;

FIG. 4 is a sectional view of the device of FIG. 1 taken along the lines 4–4;

FIG. 5 is a fragmentary view of the device of FIG. 4 taken along the lines 5—5;

DESCRIPTION OF THE PREFERRED EMBODIMENTS

The Apparatus—Squaring/Decambering

Figure 6:
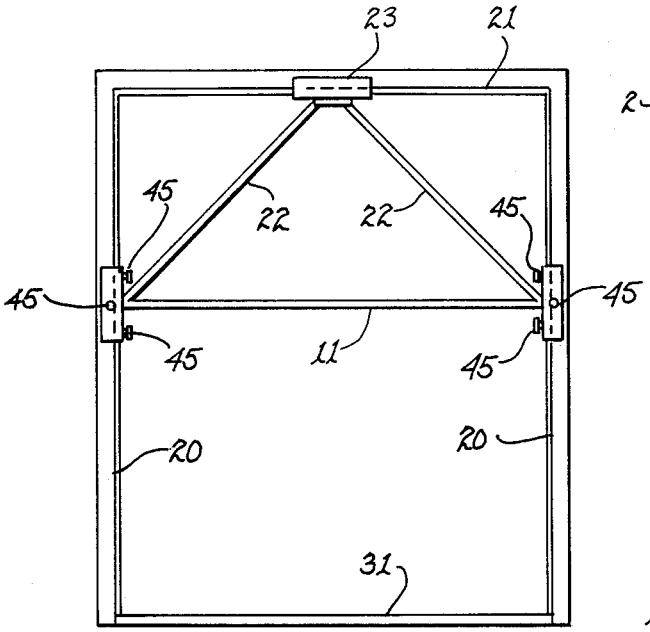
FIG. 6 is a schematic view of an optional embodiment wherein an optional truss head support is used to support a double frame.

In FIG. 1 a completed thin steel frame 1 with integral jig members 1*a*, 1*b* in a door opening setting is depicted. The frame 1 includes soffit 2, flanking stops 3, 4, flanking rabbets 5, 6, flanking trim faces 7, 8 and associated returns 9, 10. The odd numbered stops, rabbets, trim faces and returns are on the door opening, or first, side of the frame and the even numbered stops, rabbets, trim faces and returns are on the second, or off-side, of the frame.

As best seen in FIGS. 1 and 4 (wherein the frame is isolated in cross section), the middle spreader beam 11 terminates at each end in perpendicularly disposed first braces 12, extending from each end of the beam 11 and embracing the rabbet 5 and trim face 7 of the jambs 20. The middle spreader beam is temporarily attached to the jambs by means of screws 45 which engage both rabbets 5 and trim face 7 of the jambs. The screws 45 are tightened first on the rabbets to decamber the frame; then the trim faces are secured by screws 45. A cooperating pair of foot spreader bars 30, 31 have perpendicular tabs 32, 33 respectively which in this embodiment are affixed to rabbets 5 and 6 respectively by means of self-tapping screws 34. Auxiliary braces 14 are fastened to the beam 11 by means of screws 16, further details of which can be better seen in FIGS. 4 and 5 wherein the metal screw 16 engages hole 18 in beam 11. Gusset 19 braces legs 15*a* and 15*b*.

As best seen in FIGS. 2 and 3 the foot spreader means is equipped with a leveling means 36 wherein two cross braces 37 (which may be carried above or below bars 30,31) carry a threaded bolt 38 which at one end has a foot 40 which swivels around the end 41 of the bolt 38. The other end 42 has a slot to receive a screwdriver for turning the bolt 38. The height of the foot 40 is adjusted by turning the bolt 38, and locked in place by nut 39. The cross members 37 may be attached by any suitable means (here screws 43) to the foot spreader bars 30, 31.

The Apparatus—Self Shimming Anchor

Referring specifically to FIG. 4 the details of the self-shimming apparatus are clearly displayed. A girder 51 is in this embodiment welded to the inside surface 7*a* of trim face 7, the inside surface 99 of return 9, the inside surface 100 of return 10 and inside surface 8*a* of trim face 8 at the leg 52 of the girder 51. The girder 51 has a tapped bore adapted to receive the external threads 54 of tube 55. Tube 55 is provided with a swivel foot 40 inserted on the tube and contained by means of flared end 56 and lock nut 59. Screw 70 has a head 71 larger than the axial bore 72 of tube 55. Any numbers of anchoring sub-assemblies 50 desired may be employed; however, the presently preferred number is. 4 on each jamb.

The Method of Assembly of Squaring/Decambering Apparatus

In the presently preferred embodiment the following steps are followed in assembling the combination door frame and jig at the assembly plant, in the process of which the frame is reliably squared and decambered, which condition is preserved through shipment and eventual installation in a suitable door opening: A. Provide unassembled door frame components including two jambs 20 and header 21 B. First Side Operation 1. Position frame 1 with door opening (first) side up
2. Set temporary door width spacing jig 85 to engage soffit 2 adjacent header to set minimum tolerance on door opening width.
3. Set interlock tabs (not shown) to engage jambs 20 with header 21
4. Clamp on temporary corner squaring jigs 90 to rabbets 5 by means of C-shaped vise grip clamps 95
5. Affix semi-permanent middle spreader bar 80 first to rabbet 5 and then to trim face 7 (second)
6. Affix semi-permanent foot spreader bar 30/31 to rabbets 5 on first side of jambs
7. Check all measurements
8. Weld header to jambs on first side
9. Remove temporary corner squaring jigs 90 and spacing jig 85
10. Grind welds and paint.

C. Off-Side Operation

1. Turn frame over (off side is now facing up)
2. Engage temporary spacing jig 80 to enclose trim face 8 of jambs near mid-point of jambs length
3. Clamp on temporary corner squaring jigs 90 to rabbets 6 by means of C-shaped vise grip clamps 95
4. Bolt extension 15 to middle spreader bar to contact off-side rabbets 6
5. Affix semi-permanent foot spreader bar 30/31 to off-side rabbets 6

6. Check all measurements
7. Weld header 21 to jambs 20 on off side
8. Remove temporary corner squaring jigs 90
9. Grind welds and paint.

Figure 11:
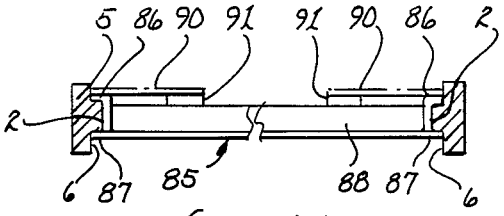
FIG. 11 is a section of FIG. 10 taken along the lines 11—11, with a squaring (minimum width) jig added to the view.
Figure 10:
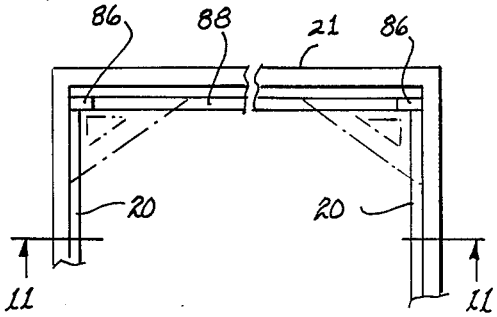
FIG. 10 is a partial view, in elevation, of the header and jambs with a temporary jig in place.
Figure 7:
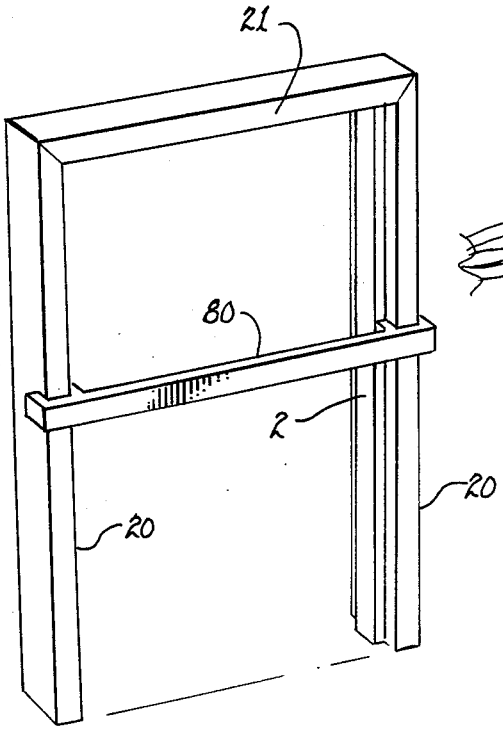
FIG. 7 is a view of the jambs and header during a step in the process of assembling the same according to this invention.
Figure 8:
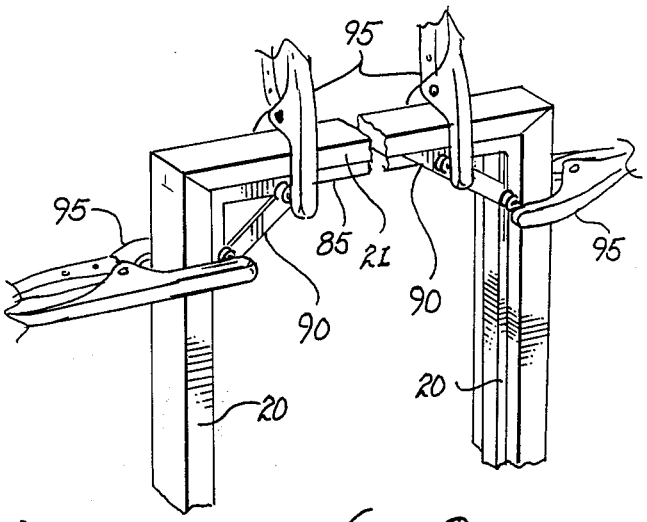
FIG. 8 is a view of the same jambs and header in a subsequent step of this process.
Figure 9:
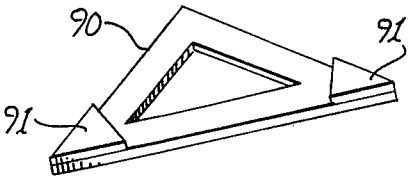
FIG. 9 is a perspective view of a device, enlarged, used in the step illustrated in FIG. 8.

The squaring jig 90 has a shim pad 91, the purpose of which is to provide clearance for door opening width minimum tolerance spacing jig 85. As shown in FIGS. 10 and 11 the jig 85 fits against the header 21 and engages the soffit 2 and rabbets 5, 6 of each jamb by means of legs 86, 87 extending from bar 88. The shim pads 91 adjust for the space taken by legs 86 when the squaring jig 90 is fitted into the corners made by header 21 and jambs 20.

The resulting apparatus is relatively lightweight, easily portable and proof against deformation until ready for use. Optionally, in a larger frame, header support can be furnished by means of trusses 22 terminating in support means 23, as seen in FIG. 6.

Method of Installation

The apparatus shown in FIG. 1 is ready for installation at the job site, in a typical instance wherein the material surrounding the wall opening is a wood stud wall opening surround W, which opening has been roughly framed to the size of the door frame, with some tolerance. If the door frame opening is somewhat out of square or the studs are twisted the condition can be somewhat corrected and the frame can be securely fastened to the surround W by means of the shim and anchoring subassembly 50 which is shown in detail in FIG. 4. The foot 40 is advanced toward the wall opening surround W by removing access plug 58 and advancing tube 55 by means of a socket wrench (not shown) applied to bolt head 57 to cause the foot 40 to contact the surround W. The self-tapping screw 70 is inserted in the axial opening in tube 55 and screwed into the surround. The access cover 58 is replaced. The gap 60, if any, between the return and the face 61 of surround W is closed by a bead of caulking compound (not shown) or other methods known to the trade. The integral jig is left in place until any construction activities that could affect the square and camber-free condition of the door frame have been completed. The jig is then removed and the door hung. Then the door frame is painted and the access plugs 58 become virtually unnoticeable.

For the convenience of the reader a list of numbers used on various parts is listed hereafter:

| | | | |
|---|---|---|---|
| 1. | frame | 37. | cross members |
| 1a. | integral jig member | 38. | bolt |
| 1b. | integral jig member | 39. | lock nut |
| 2. | soffit | 40. | swivel foot |
| 3. | stop | 41. | end |
| 4. | stop | 42. | slot |
| 5. | rabbet | 43. | screw (girder) |
| 6. | rabbet | 45. | screw |
| 7. | trim face | 50. | anchoring sub-assembly |
| 7a. | inside surface of trim face | 51. | girder |
| 8. | trim face | 52. | leg |
| 8a. | inside of trim face | 53. | tapped bore |

-continued

| | | | |
|---|---|---|---|
| 9. | return | 54. | external threads |
| 10. | return | 55. | tube |
| 11. | beam | 56. | flared end |
| 12. | first braces | 57. | bolt head |
| 14. | auxiliary braces | 58. | access plug |
| 15a. | base leg | 59. | lock nut |
| 15b. | extension leg | 60. | gap |
| 15c. | brace leg | 61. | face of W |
| 16. | self tapping screw | 70. | screw |
| 17. | slot | 71. | head |
| 18. | hole | 72. | axial bore |
| 19. | gusset | 80. | temporary middle spacing jig |
| 20. | jambs | 85. | temporary header spacing jig |
| 21. | header | 86. | leg |
| 22. | truss | 87. | leg |
| 23. | support means | 88. | bar |
| 30. | foot spreader bars | 90. | temporary corner squaring jigs |
| 31. | foot spreader bars | 91. | shim pad |
| 32. | perpendicular tabs | 95. | C clamp |
| 33. | perpendicular tabs | 99. | inside surface of return |
| 34. | screws | 100. | inside surface of return |
| 36. | levelling mean | 140. | foot |
| | | W | surround |

What is claimed is:

1. In combination with a one-piece, thin-metal door frame having an inverted U-shape with a header connecting two vertical jambs, wherein the header of the frame is at the top and the open end of the U is at the foot, the frame having means on the face of the frame defining a soffit, two stops flanking said soffit, two rabbets flanking said stops and two trim faces flanking said rabbets; apparatus for maintaining a factory decambered fame consisting essentially of:

a middle spreader means having a beam extending between said jambs at a location intermediate the header and the foot; elongate first braces extending from each end of said beam perpendicular to the beam length, said first braces having means, not engaging the strike plate or hinge locations of the frame, for releasably engaging a first rabbet and an associated trim face of each jamb on the door opening or off side of the frame; an auxiliary brace detachably affixed to said beam and bearing on the second rabbet on the other side of the frame on each of said jambs; a pair of cooperating foot spreader bars releasably attached to said jambs at said open end, said bars being spaced from said middle spreader bar.

2. The apparatus of claim 1 comprising means for leveling said foot spreader bars comprising at least two cross members spanning said foot spreader bars, a threaded bolt rotatably carried by each of said cross braces and having two ends, one of which is adapted to engage the floor beneath the foot and the other of which is provided with means for engaging a turning tool.

3. The apparatus of claim 1 further comprising a support beam, one end of which engages said middle spreader and the other end of which releasably engages said header.

* * * * *